US005592955A

United States Patent [19]

Keritsis

[11] Patent Number: 5,592,955

[45] Date of Patent: Jan. 14, 1997

[54] CIGARETTE WITH INSULATING SHELL AND METHOD FOR MAKING SAME

[75] Inventor: Gus D. Keritsis, Richmond, Va.

[73] Assignee: Philip Morris Incorporated, New York, N.Y.

[21] Appl. No.: 192,737

[22] Filed: Feb. 7, 1994

[51] Int. Cl.[6] ..... A24F 1/28; A24D 1/02

[52] U.S. Cl. ..... 131/175; 131/329

[58] Field of Search ..... 131/329, 70, 330, 131/175, 187, 191, 194, 174; 128/202.21

[56] References Cited

U.S. PATENT DOCUMENTS

| | | | |
|---|---|---|---|
| 1,555,320 | 9/1925 | Weil | 131/349 |
| 2,718,889 | 9/1955 | Claussen | 131/349 |
| 3,158,158 | 11/1964 | Womack | 131/175 X |
| 3,220,418 | 11/1965 | Cohn | 131/175 X |
| 4,480,650 | 11/1984 | Weinert . | |
| 4,570,650 | 2/1986 | Sirota | 131/349 |
| 4,585,014 | 4/1986 | Fry | 131/175 |
| 4,637,407 | 1/1987 | Bonanno et al. | 131/175 |
| 4,685,477 | 8/1987 | Valdez | 131/175 |
| 4,800,903 | 1/1989 | Ray et al. | 131/202.21 X |
| 4,819,666 | 4/1989 | Turner | 131/175 X |
| 4,903,714 | 2/1990 | Barnes et al. | 131/194 X |
| 4,915,117 | 4/1990 | Ito . | |
| 4,981,522 | 1/1991 | Nichols et al. . | |
| 4,991,595 | 2/1991 | Jones | 131/175 |
| 4,991,606 | 2/1991 | Serrano et al. . | |
| 5,076,296 | 12/1991 | Nystrom et al. . | |
| 5,105,830 | 4/1992 | Brackmann et al. . | |
| 5,105,838 | 4/1992 | White et al. . | |
| 5,144,962 | 9/1992 | Counts et al. | 128/202.21 X |
| 5,152,304 | 10/1992 | Bokelman et al. . | |
| 5,159,940 | 11/1992 | Hayward et al. . | |
| 5,179,817 | 1/1993 | Barnes et al. . | |
| 5,179,966 | 1/1993 | Losee et al. | 128/202.21 X |
| 5,249,586 | 10/1993 | Morgan et al. | 128/202.21 X |
| 5,261,424 | 11/1993 | Sprinkel | 128/202.21 X |
| 5,269,327 | 12/1993 | Counts et al. | 128/202.21 X |

FOREIGN PATENT DOCUMENTS

| | | | |
|---|---|---|---|
| 4-183378 | 6/1992 | Japan . | |
| 11426 | of 0000 | United Kingdom | 131/175 |
| 2094130 | 9/1982 | United Kingdom . | |

*Primary Examiner*—Jennifer Bahr

*Attorney, Agent, or Firm*—Burns, Doane, Swecker & Mathis, LLP

[57] ABSTRACT

A cigarette is provided including a reusable, air-permeable shell having a cavity and smokable material for being positioned in the cavity and smoked in the shell. The shell conceals and retains the smokable material before, during, and after smoking. A method of making a cigarette is also described.

18 Claims, 3 Drawing Sheets

CIGARETTE WITH INSULATING SHELL AND METHOD FOR MAKING SAME

BACKGROUND AND SUMMARY OF THE PRIOR ART

The present invention relates to smoking articles and, more particularly, to cigarettes.

Conventional cigarettes include a rod of smokable material, usually shredded tobacco material, wrapped in a combustible, air permeable paper wrapper. A filter, such as an acetate tow filter, is often wrapped in a substantially air-impermeable plug wrap paper, and is attached to an end of a wrapped tobacco rod by tipping paper. Non-filter cigarettes are generally 70 mm in length. Filter cigarettes are generally either 85 mm in length, which length includes a filter between 20–25 mm in length, or 100 mm in length, which length includes a filter between 25 and 32 mm in length. Most cigarettes are approximately 8 mm in diameter.

When a cigarette is lit to form a coal at one end, the cigarette burns either through puffing, when air is drawn through the cigarette through the coal and mainstream smoke is formed, or through smoldering, when air is moved upward around the coal and sidestream smoke is formed. During puffing, peak temperatures of approximately 900° C. are developed. It is generally understood that, in conventional cigarettes, about twice as much tobacco is burned in the interval between puffs compared with that consumed during puffing.

Various efforts have been directed to reducing sidestream smoke emanating from lit cigarettes. It is known that reducing the permeability of the cigarette paper tends to reduce the burn rate of the cigarette and, consequently, reduces sidestream smoke. However, it is also understood that a cigarette constructed from cigarette paper having a permeability below about 5 Coresta units may not sustain smoldering. U.K. Patent Application 2094130 teaches that sidestream smoke is reduced in cigarettes manufactured with cigarette paper having a permeability of no more than 3 Coresta units due to viscous flow (i.e., flow through the paper through openings inherent from the paper making process), as contrasted with permeability due to inertial forces, (i.e., permeability due to flow through perforations formed in the paper). As explained in that document at page 1, lines 18–19, the ratio of the coefficient of diffusion of oxygen through nitrogen in the paper and the thickness of the paper must fall within a certain range. The desired ratio depends to a certain extent on design factors of the smoking article, such as the type and form of the tobacco and the diameter of the smoking rod.

Another technique for reducing the sidestream smoke of cigarettes involves adding a burn modifier to the cigarette wrapper paper. Various compounds may be added to the cigarette wrapper paper to affect the sidestream smoke level. U.S. Pat. No. 5,152,304, for example, indicates that the use of an acidic salt added to the cigarette wrapper paper reduces sidestream smoke. At certain levels, these additives may impart their own note to the taste of a cigarette.

Yet another technique for reducing sidestream smoke in a cigarette involves providing an insulating, air permeable wrapper or tube around a tobacco rod. U.S. Pat. No. 5,105,838 teaches that a cigarette manufactured with a tube of air permeable insulating material, e.g., a ceramic insulating material surrounding a tobacco rod, produces reduced sidestream smoke levels. U.S. Pat. No. 4,915,117 teaches providing a cigarette including a thin ceramic sheet for holding the tobacco. U.S. Pat. No. 4,480,650 teaches a cigarette formed with a paper wrapper having a clay coating which burns at a slower rate than the tobacco ember so as to control the rate of heat transfer from the smoldering coal to a surrounding environment. See also U.S. Pat. No. 5,159,940 which utilizes a non-combustible, substantially cylindrical hollow ceramic sleeve in a smoking article which generates substantially no sidestream smoke. Japanese Patent Document 04-183,378, published Jun. 30, 1992, shows a cigarette within a pipe that will not self-sustain its smolder.

Accordingly, the search has continued for cigarettes exhibiting reduced sidestream smoke without adversely affecting the taste of the cigarette.

SUMMARY OF THE INVENTION

It is an object of the present invention to provide a cigarette exhibiting reduced sidestream smoke.

It is a further object of the present invention to provide such a cigarette in a manner that does not detract from the taste of the cigarette.

In accordance with one aspect of the present invention, a device for use in smoking a rod of smokable material is provided. The device includes a reusable, non-combustible, air-permeable shell concealing and retaining a rod of smokable material before, during, and after smoking.

In accordance with another aspect of the present invention, a cigarette is provided which includes a reusable, non-combustible, air-permeable shell having a cavity and smokable material for being positioned in the cavity and smoked in the shell. The shell conceals and retains the smokable material before, during, and after smoking.

In accordance with yet another aspect of the present invention, an assembly for use with a cigarette, the cigarette including a reusable, air-permeable shell having a cavity and smokable material for being positioned in the cavity and smoked in the shell, the shell concealing and retaining the smokable material before, during, and after smoking, is provided. The assembly includes a filter and means for holding the filter in position relative to a shell of a cigarette.

In accordance with still another aspect of the present invention a method of making a cigarette includes the step of inserting smokable material in a cavity of a reusable, air permeable shell.

Other objects, aspects and advantages of the present invention will become apparent to one skilled in the art in view of the following.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENT

Figure 1:
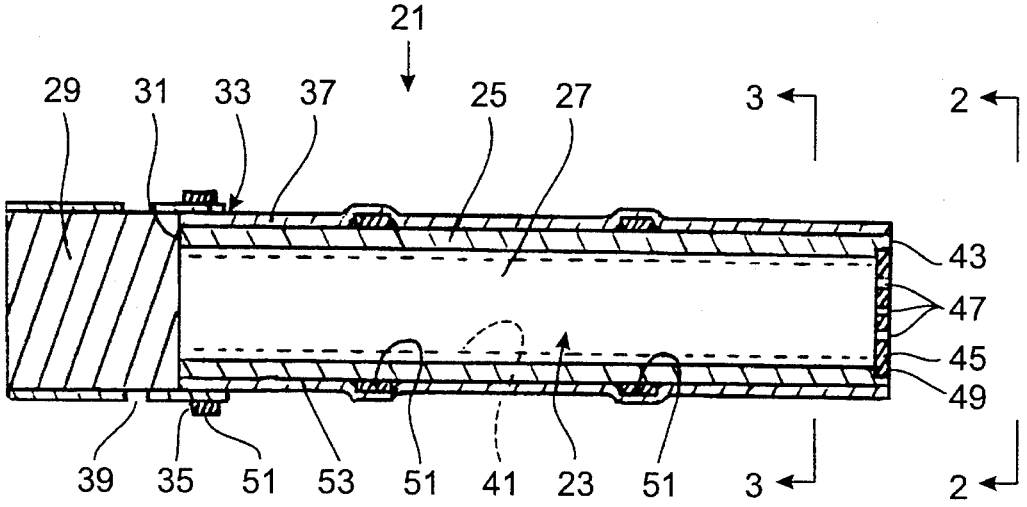
FIG. 1 is a cross-sectional side view of a cigarette according to an embodiment of the present invention.
Figure 2:
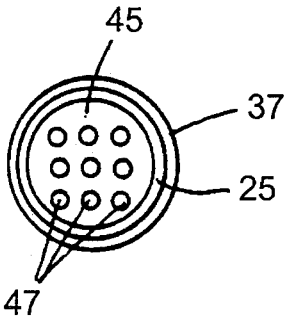
FIG. 2 is a view taken at section 2—2 of the cigarette of FIG. 1.
Figure 3:
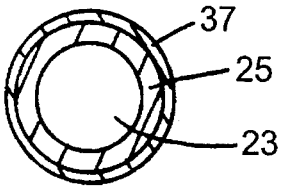
FIG. 3 is a view taken at section 3—3 of the cigarette of FIG. 1.

A cigarette 21 according to a preferred embodiment of the present invention is shown with reference to FIGS. 1–4. The cigarette 21 includes a rod 23 of smokable material, preferably tobacco, and a reusable, air-permeable shell 25 having a central cavity 27 in which the rod is disposed. The cigarette 21 is preferably provided with a disposable filter 29, such as a conventional cellulose acetate filter, removably mounted at a first end 31 of the shell 25.

An assembly 33 for mounting the filter 29 to the first end 31 of the shell 25 preferably includes disposable tipping paper 35 for surrounding at least a portion of the filter attached with an adhesive in a substantially conventional manner to a disposable shell wrapper paper 37 for surrounding at least a portion, preferably all, of the shell. If desired, the filter 29 is surrounded, in a conventional manner, with plug wrap (not shown), and tipping paper 35 surrounds at least a portion of the plug wrap. The tipping paper 35 and, if provided, the plug wrap, is preferably substantially air-impermeable, however, if desired to obtain a particular resistance to draw and reduction of smoke components by air ventilation, a porous plug wrap is provided and perforations 39 are provided in a known manner through the tipping paper.

Because the shell 25 is reusable, it is preferred that the rod 23 is adapted to be easily inserted into the cavity 27. Various means according to the present invention are available for easily inserting the rod 23 into the cavity. Such means include providing a smokable or disposable rod wrapper 41 (shown by dotted lines in FIG. 1) around the rod 23 to maintain the rod in a substantially rigid condition.

Rod wrappers 41 suitable for use with the cigarette 21 of the present invention include a conventional paper or tobacco cigarette wrapper that is smoked with the rod 23 and/or a removable plastic or paper wrapper that is adapted to be slipped off of the rod after the rod is inserted in the cavity 27. If the wrapper 41 is to be removed from the rod 23, the smoker preferably holds a narrow-ended device such as a pencil eraser against the tip of the rod at the second end 43 of the shell 25 as the wrapper is withdrawn from the shell to prevent the rod from being withdrawn with the wrapper. As an alternative to providing the rod 23 in a pre-wrapped form, of course, the smokable material may be provided loose and inserted into the shell 25 in desired amounts by the smoker.

The assembled cigarette 21 preferably has a permeability in the range of approximately 5 to 40 Coresta units. The shell 25 preferably has a permeability of greater than 5 Coresta units and the shell wrapper paper 37 preferably has a permeability of less than 40 Coresta units. During smoking, the heat generated by the burning rod 23 preferably discolors, but does not burn, the shell wrapper paper 37 to indicate the amount of the rod that has been smoked. Further, the shell wrapper paper 37 may be used to tighten controls on porosity, as where, for example, it is desired to use a highly porous shell 25 to decrease overall weight of the cigarette 21 while providing a less porous wrapper paper to compensate for the greater porosity of the shell.

The filter 29 and the shell wrapper paper 37 are preferably provided in a preassembled form permitting ease of insertion of the shell inside the shell wrapper paper. The shell 25 is preferably cylindrical in shape and the shell wrapper paper 37 is preferably also a cylindrical tube, or adapted to be expanded into a cylindrical shape, and has an inside diameter substantially equal to the outside diameter of the shell. Attached filter 29 and shell wrapper paper 37 assemblies are preferably provided in packages (not shown) in a manner similar to the manner in which conventional cigarettes are provided. If desired, the shell wrapper paper 37 is omitted and the filter 29 is attached to the shell 25 by a tubular portion of the tipping paper 35 surrounding the filter.

The cigarette 21 preferably further includes a reusable, air permeable cap 45 adapted to be attached to the second end 43 of the shell 25. The cap 45 preferably includes a plurality of through-holes 47, seen in FIG. 2, sufficient in size to both facilitate desired flow of air to a lit rod 23 and to prevent the rod or ashes from inadvertently falling out of the shell 25. The cap 45 is preferably attached to the second end 43 of the shell 25 by a friction fit against walls of a recessed portion 49 of the second end of the shell. If desired, other techniques for attaching the cap 45 to the shell 25 are available, such as by hingedly attaching the cap to the shell so that the cap is adapted to be raised and lowered to permit insertion of a rod 23 or removal of ash, or by providing external threads on the cap and mating internal threads on the shell. As seen in the embodiment of the cigarette shown in FIG. 6, if desired, a cap is attached at a first end of a shell as well.

The shell 25 is preferably provided with heat sinks 51 at one or more points sufficiently proximate, preferably adjacent or near, an exterior periphery 53 of the shell to substantially reduce the burn rate of a lit rod 23 if the cigarette 21 is not puffed for a sufficient length of time, and to ensure that the burn rate of the cigarette is substantially reduced when some portion or all of the rod is smoked. The heat sinks 51 preferably include metallic bands or pieces either attached to or in contact with the exterior periphery 53 of the shell at one or more locations to conduct heat away from a lit rod 23, thereby tending to reduce the burn rate of the rod. At least one heat sink 51 is preferably located near the first end 31 of the shell 25 to substantially reduce the burn rate of the cigarette 21 when the rod 23 is completely smoked or nearly completely smoked. That heat sink 51 is preferably attached to an outer surface of the tipping paper 35. Additional heat sinks 51, if desired, are positioned at intervals along the length of the exterior periphery 53 of the shell 25 to substantially reduce the burn rate of the rod 23 if the temperature of the rod is not periodically raised sufficiently, i.e., by puffing on the cigarette. The additional heat sinks 51 are preferably provided on an outer surface or, preferably, for aesthetic reasons, on an inner surface of the shell wrapper paper 37. Alternatively, heat sinks 51 are provided directly on the exterior periphery 53 of the shell 25.

The cigarette 21 is preferably comparable in size to a conventional cigarette, having a circumference between approximately 15 and 28 mm. The shell 25 preferably has a radial thickness of greater than 0.25 mm, with successful results having been achieved with shells having radial thicknesses greater than 0.75 mm. The tobacco rod 23 is preferably packed to a density of less than about 400 mg/cm$^3$ and has a circumference between 12 mm and 25 mm.

Figure 5:
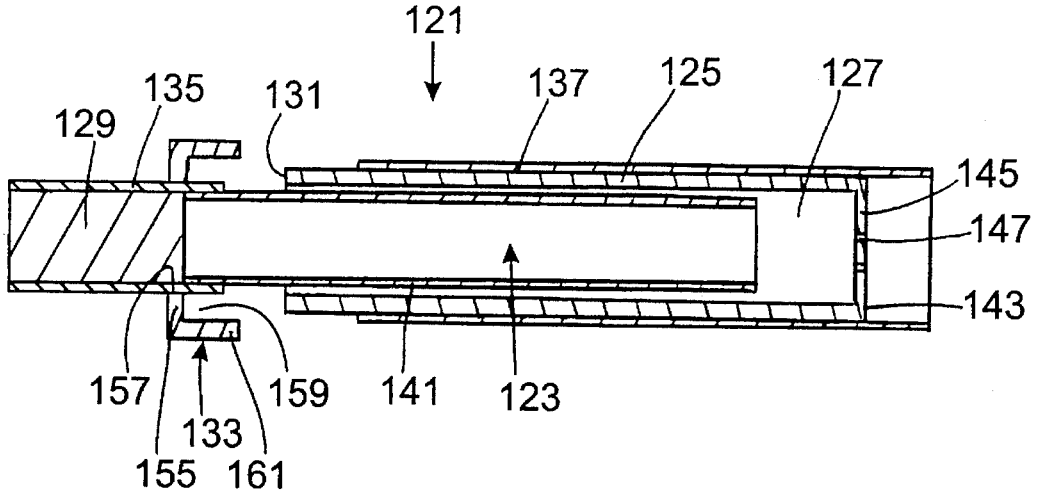
FIG. 5 is an exploded, cross-sectional side view showing the assembly of a cigarette according to another embodiment of the present invention.

A cigarette 121 according to a second embodiment of the present invention is shown with reference to FIG. 5. The cigarette 121 includes a reusable, air-permeable shell 125 having a central cavity 127 in which a rod 123 of smokable material is inserted. The shell 125 is preferably formed with an air-permeable cap 145 at a second end 143 of the shell, however, the cap may be omitted. A shell wrapper 137 is preferably provided around the shell 125 and, during smoking of the cigarette 121, the shell wrapper preferably discolors to indicate how much of the rod 123 has been smoked. The shell wrapper 137 also permits tighter control of cigarette 121 porosity.

The rod 123 is preferably wrapped in a paper or tobacco paper rod wrapper paper 141, which is preferably a cigarette wrapper containing tobacco or made out of tobacco, and is preferably attached to a filter 129 by tipping paper 135, which may be perforated to provide a desired resistance to draw. The rod 123 and filter 129 assembly is preferably provided with an assembly 133 for securing the filter to the first end 131 of the shell 125 including an enclosure cap 155 that includes a central opening 157 through which the filter is fitted. The central opening 157 is preferably the same size or slightly smaller than the outside diameter of the filter 129 so that the enclosure cap 155 is held securely in place relative to the filter. While the disposable rod 123 and filter 129 assembly may by provided with a disposable enclosure cap 155 that is permanently attached to the assembly, e.g., by an adhesive, it is preferred that the enclosure cap is reusable and removable from the filter after the rod is smoked.

The enclosure cap 155 further includes an annular recess 159 and an annular rim 161 around the central opening 157. The first end 131 of the shell 125 is received in the annular recess 159 and is preferably held in position relative to the filter 129 and rod 123 assembly by a friction fit with the annular rim 161. Alternative techniques for holding the filter 129 and rod 123 assembly in place relative to the shell 125 include forming an interior thread (not shown) on the annular rim 161 and a mating external thread (not shown) on the shell 125. The enclosure cap 155 preferably prevents undesired air flow between the shell 125 and the enclosure cap, except to the extent that air flow is desired for obtaining a desired resistance to draw.

The rod 123 is preferably prewrapped in the rod wrapper 141, however, smokable material may be packed in the rod wrapper by the smoker to form the rod. Further, if desired, the filter 129, the rod wrapper 141, and the smokable material for forming the rod 123 are all assembled by the smoker. For example, smokable material for forming the rod 123 is packed by the smoker into the rod wrapper 141. The filter 129 is positioned relative to an end of the thus-formed rod 123 by placing the rod wrapped in the rod wrapper 141 inside a recess formed by tipping paper 135 and an end of the filter and holding the assembly together by inserting the assembly into the opening 157 of the enclosure cap 155 so that the enclosure cap presses the tipping paper into contact with the rod wrapper.

Figure 6:
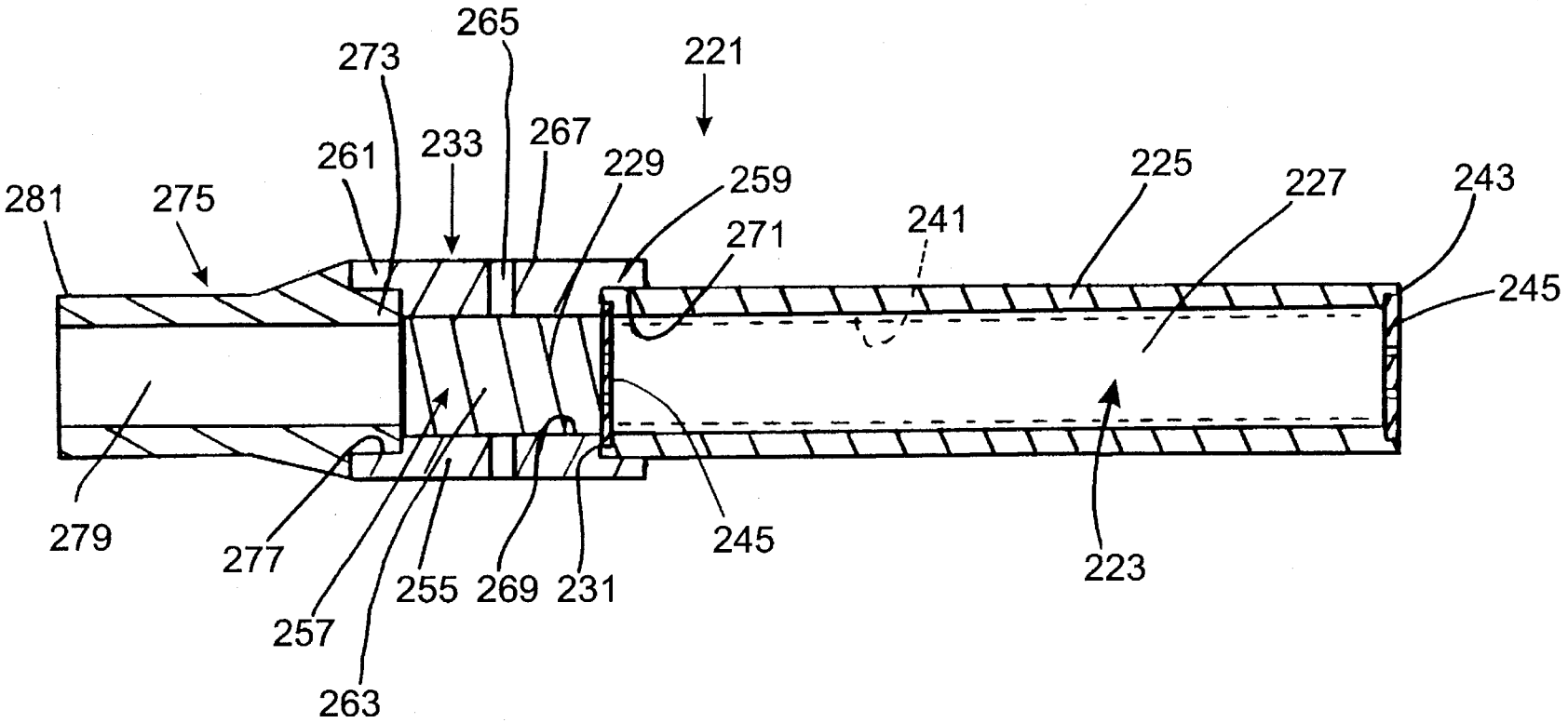
FIG. 6 is a cross-sectional side view of a cigarette according to a further embodiment of the present invention.

A third embodiment of a cigarette 221 according to the present invention is shown with reference to FIG. 6. The cigarette 221 preferably includes a shell 225 similar to the shell 25 shown in FIGS. 1 and 4, although the shell 125 shown in FIG. 5 is adapted to be used as well. The shell 225 shown in FIG. 6 is shown with an air permeable cap 245 on the first end 231 and the second end 243 of the shell, although, as in the embodiment shown in FIGS. 1, 4, and 5, the cap may be provided on only one end or not at all.

A rod 223 of smokable material is positioned in the cavity 227 of the shell 225. If desired, a shell wrapper (not shown) is placed around the shell 225 and a rod wrapper 241, preferably a cigarette wrapper containing or made out of tobacco, is provided around the rod 223. As in the other embodiments, the rod 223 is positioned in the shell 225 either by positioning a preformed rod in the shell or by the smoker packing smokable material into the shell in a desired quantity.

The shell 225 is attached, at its first end 231, to a filter 229 by an assembly 233 for holding the shell in position relative to the filter including a holder 255 having an interior passage 257. The holder 255 is preferably substantially cylindrical in shape. The interior passage 257 is also preferably substantially cylindrical and has a first end portion 259 and a second end portion 261 having a greater diameter than a middle portion 263 to facilitate insertion of the filter 229 into the middle portion. The holder 255 is preferably provided with one or more radial through holes 265 extending from an exterior surface 267 of the holder to the interior surface 269 of the middle portion 263 to obtain a desired resistance to draw.

The first end 231 of the shell 225 is received in the first end portion 259 of the passage 257 of the holder 255 and is preferably held in position relative to the holder by a substantially air-impermeable friction fit between the interior surface 271 of the first end portion which facilitates ease of insertion and removal of the shell. The holder 255 is preferably substantially rigid, but is adapted to deform sufficiently to allow the shell 225 to be securely held in position. Preferably, the holder 255 is formed of a wood, ivory, plastic or other such material and is reusable. If desired, the shell 225 is permanently secured to the holder 255 by other attachment techniques, such as by providing threads (not shown) on the exterior of the first end 231 of the shell and mating threads (not shown) on the interior surface 271 of the first end portion 259 of the passage 257 of the holder. The diameter of the rod 223 and the diameter of the filter 229 are preferably substantially the same to provide for maximum exposure of filter to the aerosol developed during smoking of the rod.

The second end portion 261 of the passage 257 of the holder 255 is preferably substantially the same diameter as the first end portion 259 and receives a male portion 273 of a mouthpiece 275. As with the shell 225 at the first end portion 259 of the passage 257 of the holder 255, the male portion 273 of the mouthpiece 275 is preferably held in position relative to the second end portion 261 of the passage by a friction fit between the male portion and the interior surface 277 of the second end portion, or by any other suitable connection technique or assembly. The male portion 273 preferably has a smaller inner diameter than the filter 229 and the rod 223 to prevent the filter from being sucked out of the assembly 233 during puffing. The mouthpiece 275 is otherwise preferably shaped like a conventional cigarette mouthpiece, and has an internal passage 279 between the male portion 273 and a flattened or rounded tip portion 281. The mouthpiece 275 is preferably formed of a substantially rigid plastic material or other material making the mouthpiece suitable for repeated reuse.

Figure 4:
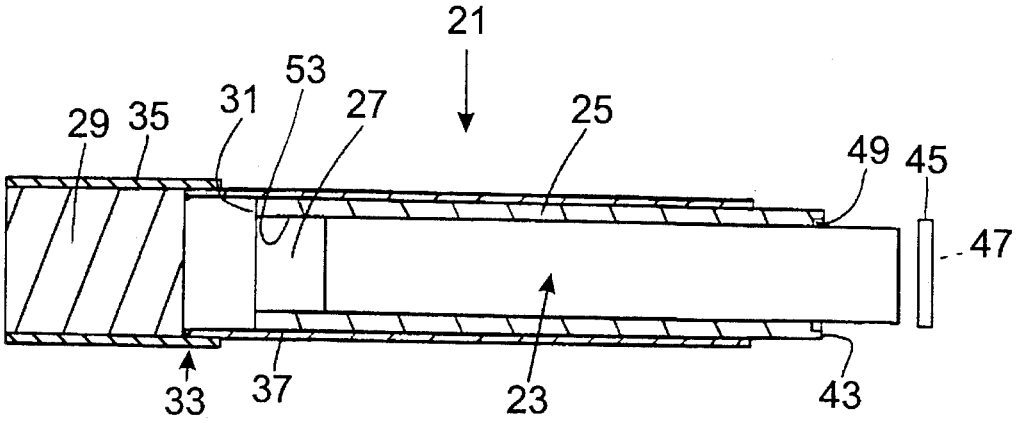
FIG. 4 is an exploded, cross-sectional side view showing the assembly of a cigarette according to an embodiment of the present invention.

A method for making a cigarette according to the present invention is seen with reference to FIG. 4. According to the method, the rod 23 of smokable material is inserted into the cavity 27 of the shell 25. The rod 23 is substantially completely concealed within and retained by the shell 25. As discussed above, to facilitate ease of assembly, the rod 23 is wrapped in a smokable or removable rod wrapper 41 that maintains the rod in a sufficiently rigid condition that facilitates insertion of the wrapped rod into the cavity. Of course, the rod 23 may be formed by the smoker inserting unwrapped smokable material into the cavity and packing it to a desired density, such as by means of a rod (not shown) or other suitably dimensioned device for packing the smokable material into the cavity. Such a rod or device having similar dimensions is also useful for removing the rod wrapper 41, as discussed above, by holding the smokable material in the shell 25 while slipping the rod wrapper 41 out of the shell.

A filter 29 is attached to the first end 31 of the shell 25, preferably by inserting the shell into a shell wrapper 37 that is preattached to the filter by tipping paper 35. In another embodiment (not shown) the shell wrapper 37 is omitted and the shell 25 is attached at its first end 31 to the filter 29 by an overhanging portion of tipping paper 35. If desired, the filter 29 and tipping paper 35 are provided separately and are attached by the smoker. The shell wrapper 37 may also be provided separately and slipped over the shell 25 by the smoker or omitted. If provided separately, the tipping paper 35 is preferably provided with an adhesive coated surface for being attached around the filter 29. If desired to enhance the attachment of the filter 29 to the shell 25, adhesive is also provided on the tipping paper 35 for removably attaching the tipping paper to the shell 25. The cap 45 is preferably attached to the second end 43 of the shell 25.

The assembly of the cigarette 121 shown in FIG. 5 is similar to the assembly of the cigarette 21. As noted above, the cigarette 121 shown in FIG. 5 preferably includes a shell 125 having a cap 145 with through holes 147 formed at the second end 143 of the shell. Accordingly, in this embodiment, a smokable material rod 123 is either preattached to a filter 129 with tipping paper 135 or wrapped or unwrapped smokable material is inserted into the cavity 127 in the shell through the first end 131 of the shell.

The filter 129 is preferably attached to the shell 125 by positioning the filter through the central opening 157 of the reusable enclosure cap 155 and fitting the first end 131 of the shell 125 into the annular recess 159 so that a friction fit between the shell and the annular rim 161 is obtained. If desired, the filter 129 and the enclosure cap 155 are provided in a preattached, disposable form, with or without a preattached, wrapped smokable rod 123 to further facilitate assembly. A shell wrapper 137 is preferably slipped around the shell to provide an indication of how much of the smokable rod 123 has been smoked and for tighter control of porosity in the cigarette 121.

The cigarette 221 shown in FIG. 6 is assembled in much the same fashion as the cigarettes 21 and 121 of FIGS. 1–4 and 5, respectively. The first end 231 of the shell 225 is inserted into the first end portion 259 of the passage 257 of the holder 255 so that it is held in position relative thereto, preferably by a friction fit. The filter 229 is inserted into the middle portion 263 of the passage 257 of the holder 255, and the male portion 273 of the mouthpiece 275 is inserted into the second end portion 261 of the passage. If desired, a cap 245 is provided at the first end 231 and/or the second end 243 of the shell 225. Shell wrapping paper is preferably slipped over the shell 225 to provide an indication of what portion of the smokable rod 223 has been smoked and for tighter control of cigarette 121 porosity.

Smoking the cigarettes 21, 121, and 221 according to the present invention is accomplished in a substantially conventional manner, and is described with reference to the cigarette shown in FIGS. 1–4. The smoker lights the smokable rod 23 at the second end 43 of the shell 25 in a conventional manner. The through holes 47 in the cap 45 preferably permit a flame to ignite the smokable material. If a cigarette lighter of the type using resistance heating elements must be used, the cap 45 is preferably attached to the second end 43 after lighting the rod 23 of smokable material.

When the smoker draws on the cigarette 21, either through the filter 29 or through the first end 31 of the shell, air passes primarily through the through holes 47 in the cap 45 to create mainstream smoke. At the same time, some air flows inwardly through the shell 25. Air is also drawn through perforations 39 in the tipping paper 35 and/or plug wrap, if such perforations are provided. During the intervals between puffs on the cigarette 21, the shell 25 and the cap 45 permit sufficient air flow to the lit rod 23 of smokable material to avoid extinguishing the rod, but tend to minimize burning between puffs, thereby minimizing sidestream smoke. Further, the shell 25 and the cap 45 serve to filter much of the sidestream smoke that is developed during the intervals between puffs.

As the rod 23 is burned during smoking, the shell 25 and cap 45, if provided, continue to serve to conceal and retain the rod. Ashes from the smoldering rod 23 are preferably retained inside the shell 25 by the cap 45. As the rod 23 is smoked, the shell wrapper paper 41 preferably discolors, but does not burn, due to heat generated by the burning rod, and indicates to the smoker how much of the rod has been consumed. When the rod 23 has been fully, or nearly fully consumed, the heat sinks 51 in the shell 25 preferably substantially reduce the burn rate of the rod. Preferably, additional heat sinks 51 are provided at spaced intervals along the length of the shell 25 to substantially reduce the burn rate of the rod 23 if the temperature of the rod is not raised by puffing on the cigarette 21 for a sufficient length of time.

Upon completion of smoking, the cap 45 is removed and the ashes from the smoked rod are allowed to fall out of the shell. The filter 29 and, if provided, the shell wrapper 41 are removed from the shell 25 and discarded. Ashes may also be removed from the shell 25 through the first end 31 upon removing the filter 29. The shell 25 is preferably cleaned periodically, such as by conventional pipe cleaners and/or with water or other cleaning fluid.

The cigarette of the present invention reduces sidestream smoke from smokable material while not appreciably changing the character of the smoking experience. Further still, the cigarette and the components of the cigarette of the present invention are adapted to be provided in either preassembled form or in a form for assembly by the smoker.

While this invention has been illustrated and described in accordance with a preferred embodiment, it is recognized that variations and changes may be made therein without departing from the invention as set forth in the claims.

What is claimed is:

1. A device, for use in smoking a rod of smokable material, comprising:

an air permeable shell adapted to conceal and retain the rod of smokable material before, during, and after smoking; the shell being reusable to conceal and retain a subsequent rod of smokable material after a preceding rod of smokable material has been smoked, the shell having a permeability of greater than 5 Coresta units;

an air permeable cap attachable to at least one end of the shell;

an air permeable wrapper around the shell; and wherein the wrapper material is paper.

2. A device for use in smoking a rod of smokable material, comprising:

an air permeable shell adapted to conceal and retain the rod of smokable material before, during, and after smoking; the shell being reusable to conceal and retain a subsequent rod of smokable material after a preceding rod of smokable material has been smoked, the shell having a permeability of greater than 5 Coresta units;

an air permeable cap attachable to at least one end of the shell;

an air permeable wrapper around the shell;

and wherein the wrapper material is sufficiently sensitive to heat that the wrapper material discolors as a result of heat generated by a burning rod of smokable material concealed in the shell and provides an indication of what portion of the rod of smokable material has been smoked.

3. A device for use in smoking a rod of smokable material, comprising:

an air-permeable shell adapted to conceal and retain a rod of smokable material before, during, and after smoking, the shell being reusable to conceal and retain a subsequent rod of smokable material after a preceding rod has been smoked, the shell having a permeability of greater than 5 Coresta units;

an air permeable cap attachable to at least one end of the shell; and an air permeable wrapper material around the shell, wherein the wrapper material is less porous than the shell.

4. The device set forth in claim 3, wherein the wrapper material is sufficiently sensitive to heat that the wrapper material discolors as a result of heat generated by a burning rod of smokable material concealed in the shell and provides an indication of what portion of the rod of smokable material has been smoked.

5. The device set forth in claim 3, wherein the wrapper material is preformed in a tubular shape to receive the shell.

6. The device set forth in claim 5, wherein the wrapper material is attached, at one end, to a filter.

7. The device set forth in claim 3, wherein the air permeable cap is formed with one or more perforations.

8. The device set forth in claim 3, further comprising a filter and means for securing the filter to one end of the shell.

9. The device set forth in claim 8, further comprising tipping paper around the filter.

10. The device set forth in claim 9, wherein one or more ventilation holes are formed in the tipping paper.

11. The device set forth in claim 8, further comprising an air permeable wrapper material around the shell.

12. A device for use in smoking a rod of smokable material, comprising:

an air permeable shell adapted to conceal and retain the rod of smokable material before, during, and after smoking; the shell being reusable to conceal and retain a subsequent rod of smokable material after a preceding rod of smokable material has been smoked, the shell having a permeability of greater than 5 Coresta units;

an air permeable wrapper around the shell;

wherein the wrapper material is preformed in a tubular shape to receive the shell; and wherein the wrapper material is attached, at one end, to a filter.

13. A device, for use in smoking a rod of smokable material, comprising:

an air permeable shell adapted to conceal and retain the rod of smokable material before, during, and after smoking; the shell being reusable to conceal and retain a subsequent rod of smokable material after a preceding rod of smokable material has been smoked, the shell having a permeability of greater than 5 Coresta units;

an air permeable cap attachable to at least one end of the shell;

and further comprising a filter and means for securing the filter to one end of the shell.

14. The device set forth in claim 13, further comprising tipping paper around the filter.

15. The device set forth in claim 14, wherein one or more ventilation holes are formed in the tipping paper.

16. The device set forth in claim 13, further comprising an air permeable wrapper material around the shell.

17. A device for use in smoking a rod of smokable material, comprising:

an air-permeable shell adapted to conceal and retain a rod of smokable material before, during, and after smoking, the shell being reusable to conceal and retain a subsequent rod of smokable material after a preceding rod of smokable material has been smoked, the shell having a permeability of greater than 5 Coresta units; and an air permeable cap attachable to at least one end of the shell; and one or more pieces of material disposed sufficiently proximate an exterior surface of the shell that the pieces of material act as heat sinks to reduce a burn rate of a burning rod of smokable material.

18. The device set forth in claim 17, wherein the one or more pieces of material are metallic.

* * * * *